US009348277B2

(12) United States Patent
Hayasaki et al.

(10) Patent No.: US 9,348,277 B2
(45) Date of Patent: May 24, 2016

(54) FIXING APPARATUS

(71) Applicant: CANON KABUSHIKI KAISHA, Tokyo (JP)

(72) Inventors: Minoru Hayasaki, Mishima (JP); Hiroshi Mano, Numazu (JP); Aoji Isono, Naka-gun (JP); Masatoshi Itoh, Mishima (JP); Yusuke Isomi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/804,169

(22) Filed: Jul. 20, 2015

(65) Prior Publication Data

US 2016/0026127 A1 Jan. 28, 2016

(30) Foreign Application Priority Data

Jul. 22, 2014 (JP) ..... 2014-148884
Sep. 17, 2014 (JP) ..... 2014-189087

(51) Int. Cl.
*G03G 15/20* (2006.01)

(52) U.S. Cl.
CPC ..... *G03G 15/2039* (2013.01); *G03G 15/2042* (2013.01); *G03G 15/2053* (2013.01)

(58) Field of Classification Search
CPC ..... G03G 15/2042; G03G 15/2082
See application file for complete search history.

(56) References Cited

U.S. PATENT DOCUMENTS 6,336,027 B1 * 1/2002 Sakai ..... H05B 6/145 219/216
6,933,479 B2 * 8/2005 Tanaka ..... H05B 6/145 219/619
9,176,441 B2 * 11/2015 Yonekubo ..... G03G 15/2053

FOREIGN PATENT DOCUMENTS

JP 5135817 B2 2/2013
JP 2014-026267 A 2/2014

* cited by examiner

*Primary Examiner* — Gregory H Curran
(74) *Attorney, Agent, or Firm* — Canon USA Inc. IP Division

(57) ABSTRACT

A fixing apparatus configured to include a rotational member having a conductive layer, a coil having a helical shape, a resonance circuit including a resonance capacitor and configured to be formed together with the rotational member and the coil, a first converter driving the resonance circuit, a second converter used to control power to be supplied to the first converter, a frequency setting unit configured to set a driving frequency of the first converter according to at least one of a size of the recording material and a temperature at a sheet non-passing portion of the rotational member, and a power control unit controlling the second converter according to a temperature at a sheet passing portion of the rotational member to control the power to be supplied to the first converter from the second converter, wherein the conductive layer is caused to generate heat by electromagnetic induction.

12 Claims, 16 Drawing Sheets

| | 50 kHz | 32 kHz |
|---|---|---|
| INPUT POWER | 720 W | 1000 W |
| INPUT POWER DUTY RATIO | 80% | 80% |

| | 50 kHz | 32 kHz |
|---|---|---|
| INPUT POWER | 720 W | 1000 W → 720 W |
| INPUT POWER DUTY RATIO | 80% | 80% → 58% |

FIXING APPARATUS

BACKGROUND OF THE INVENTION

1. Field of the Invention

The present invention relates to a fixing apparatus mounted on an image forming apparatus, such as an electrophotographic copying machine, printer or the like.

2. Description of the Related Art

A fixing apparatus mounted on an image forming apparatus, such as an electrophotographic copying machine, printer or the like, is generally configured to heat a recording material bearing an unfixed toner image while conveying the recording material at a nip portion formed by a heating rotational member and a pressing roller in contact with each other, thereby fixing the toner image onto the recording material.

In recent years, a fixing apparatus employing the electromagnetic induction heating method, which can cause a conductive layer of the heating rotational member to generate heat, has been developed and put into practical use. The fixing apparatus employing the electromagnetic induction heating method has such an advantage that the warm up time is short.

Japanese Patent Application Laid-Open No. 2014-026267 discusses a fixing apparatus that can ease limitations imposed on a thickness and a material of a conductive layer.

Even the fixing apparatus discussed in Japanese Patent Application Laid-Open No. 2014-026267 cannot be free from an issue of an increase in a temperature at a sheet non-passing portion when a small-sized recording material is processed by the fixing processing.

The present invention is directed to providing a fixing apparatus capable of easily controlling a temperature of a region of the rotational member that the recording material passes through while creating a heat generation distribution according to a size of the recording material.

SUMMARY OF THE INVENTION

According to an aspect of the present invention, a fixing apparatus configured to fix an image onto a recording medium includes a rotational member having a cylindrical shape and configured to include a conductive layer, a coil having a helical shape and configured to be disposed inside the rotational member, the coil having a helix axis extending in a direction along a generatrix direction of the rotational member, a resonance circuit including a resonance capacitor and configured to be formed together with the rotational member and the coil, a first converter configured to drive the resonance circuit, a second converter configured to be used to control power to be supplied to the first converter, a frequency setting unit configured to set a driving frequency of the first converter according to at least one of a size of the recording material and a temperature at a sheet non-passing portion of the rotational member, and a power control unit configured to control the second converter according to a temperature at a sheet passing portion of the rotational member to control the power to be supplied to the first converter from the second converter, wherein the conductive layer is caused to generate heat by electromagnetic induction, and the image formed on the recording material is fixed onto the recording material with the heat of the rotational member.

According to another aspect of the present invention, a fixing apparatus configured to fix an image onto a recording medium includes a rotational member having a cylindrical shape and configured to include a conductive layer, a coil having a helical shape and configured to be disposed inside the rotational member, the coil having a helix axis extending in a direction along a generatrix direction of the rotational member, a resonance circuit including a resonance capacitor and configured to be formed together with the rotational member and the coil, a first converter configured to drive the resonance circuit, a second converter configured to be used to control power to be supplied to the first converter, a frequency setting unit configured to set a driving frequency of the first converter according to at least one of a size of the recording material and a temperature at a sheet non-passing portion of the rotational member, and a power control unit configured to control the second converter according to a temperature at a sheet passing portion of the rotational member and the driving frequency to control the power to be supplied to the first converter from the second converter, wherein the conductive layer is caused to generate heat by electromagnetic induction, and the image formed on the recording material is fixed onto the recording material with the heat of the rotational member.

Further features of the present invention will become apparent from the following description of exemplary embodiments with reference to the attached drawings.

DESCRIPTION OF THE EMBODIMENTS

In the following description, how the present invention can be embodied will be described in detail with reference to the drawings based on exemplary embodiments by way of example. However, dimensions, materials, shapes, a relative layout, and the like of component parts that will be described in these exemplary embodiments should be changed as necessary according to a configuration of an apparatus to which the present invention is applied, and various kinds of conditions. In other words, the present disclosure is not intended to limit the scope of the present invention to the exemplary embodiments that will be described below.

Figure 1:
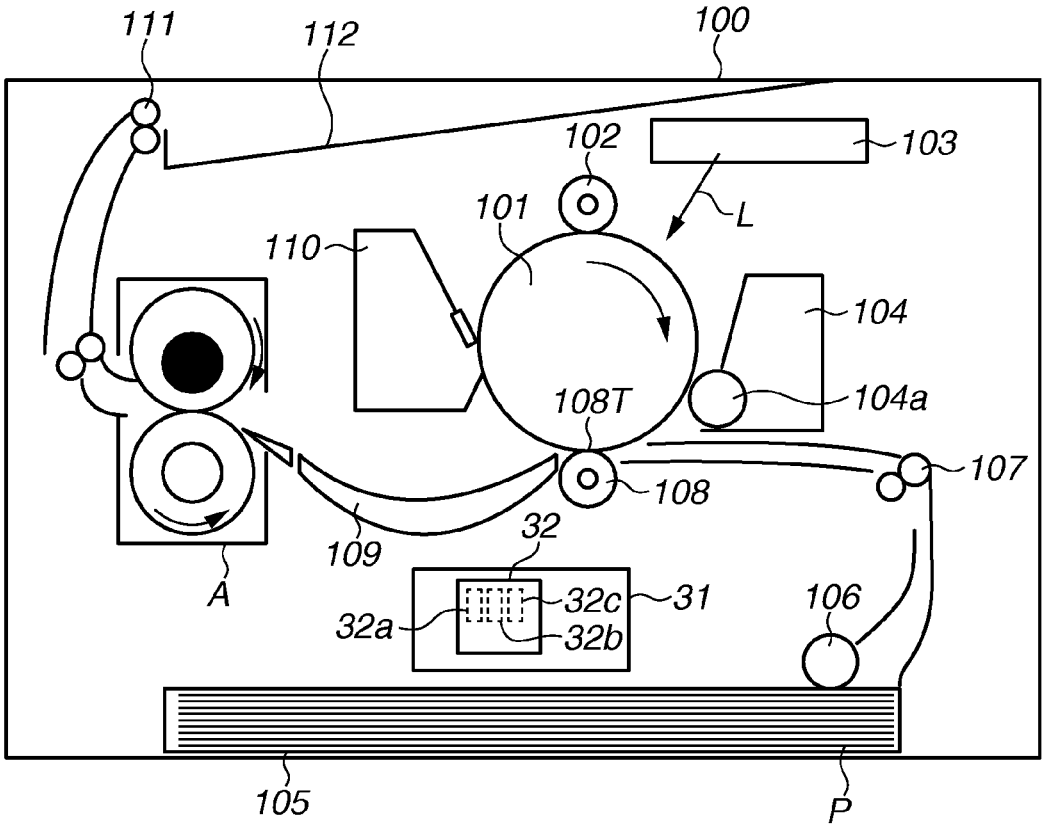
FIG. 1 is a schematic cross-sectional view illustrating an image forming apparatus.

FIG. 1 is a schematic configuration diagram illustrating an image forming apparatus 100 according to a first exemplary embodiment of the present invention. The image forming apparatus 100 according to the present exemplary embodiment is a laser beam printer using the electrophotographic process.

A controller 31 is a control unit of the image forming apparatus 100 and includes a central processing unit (CPU) (a central processing device) 32, various kinds of input and output control circuits (not illustrated), and the like. The CPU 32 includes a read only memory (ROM) 32*a*, a random access memory (RAM) 32*b*, a timer 32*c*, and the like. An electrophotographic photosensitive member 101 configured as a rotational drum (hereinafter referred to as a photosensitive drum) serves as an image bearing member, and is rotationally driven at a predetermined circumferential speed in a clockwise direction indicated by an arrow. The photosensitive drum 101 is uniformly charged by a contact charging roller 102 during the rotation process thereof so as to have a predetermined polarity and a predetermined potential. A laser beam scanner 103 outputs a laser light L on-off modulated according to image information input from a not-illustrated external apparatus, such as an image scanner and a computer. A charged surface of the photosensitive drum 101 is exposed by the laser light L, and an electrostatic latent image corresponding to the image information is formed on the surface of the photosensitive drum 101. A developing device 104 supplies a developer (toner) from a developing roller 104*a* onto the surface of the photosensitive drum 101, thereby developing the electrostatic latent image formed on the surface of the photosensitive drum 101 as a toner image. A sheet feeding cassette 105 contains recording materials P. A registration roller 107 conveys a recording material P in such a manner that a leading edge of the toner image formed on the photosensitive drum 101 and a predetermined position of the recording material P coincide with each other. Upon an input of a sheet feeding start signal, a sheet feeding roller 106 is driven, and the recording materials P contained in the sheet feeding cassette 105 are fed one by one. A fed recording material P is introduced into a transfer portion 108T, where the photosensitive drum 101 and a transfer roller 108 are in abutment with each other, after a conveyance timing is adjusted by the registration roller 107. While the recording material P is being held and conveyed at the transfer portion 108T, a transfer bias is applied from a not-illustrated power source to the transfer roller 108. The transfer bias having an opposite polarity from a charged polarity of the toner is applied to the transfer roller 108, by which the toner image formed on the photosensitive drum 101 is transferred onto the recording material P. After that, the recording material P with the toner image transferred thereon is separated from the surface of the photosensitive drum 101, and is introduced into a fixing unit A after passing through a conveyance guide 109. The toner image formed on the recording material P is heated and fixed onto the recording material P at the fixing unit A. After passing through the fixing unit A, the recording material P is discharged onto a sheet output tray 112 via a sheet output port 111. Meanwhile, the surface of the photosensitive drum 101 after the recording material P is separated therefrom is cleaned at a cleaning portion 110.

Figure 2:
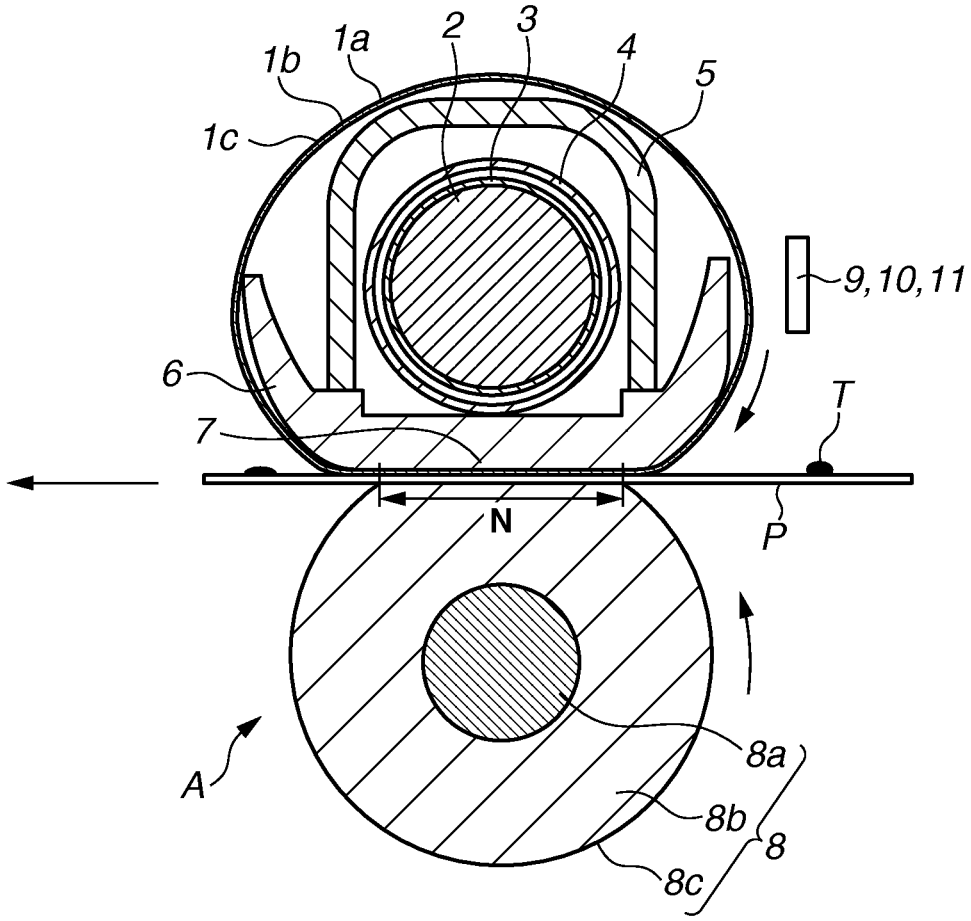
FIG. 2 is a cross-sectional view illustrating a fixing unit.
Figure 3:
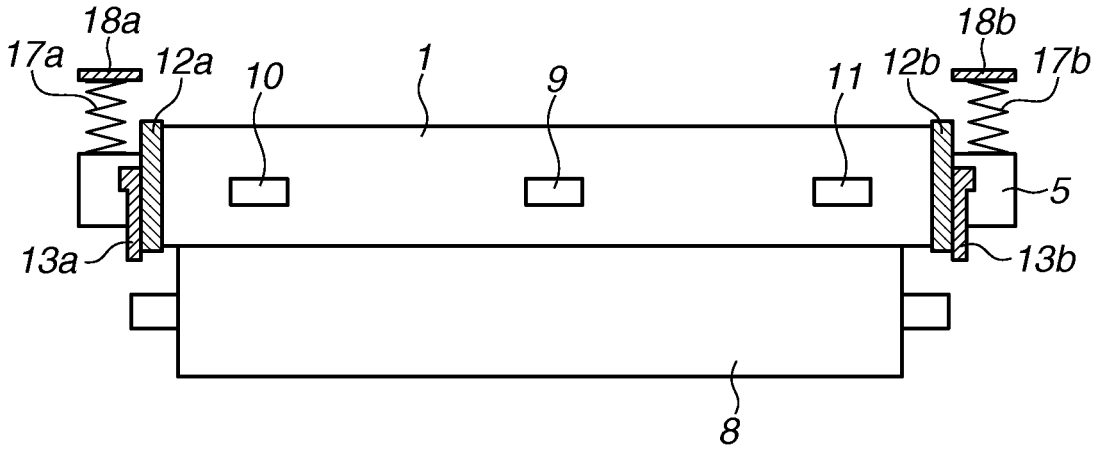
FIG. 3 is a front view illustrating the fixing unit.
Figure 4:
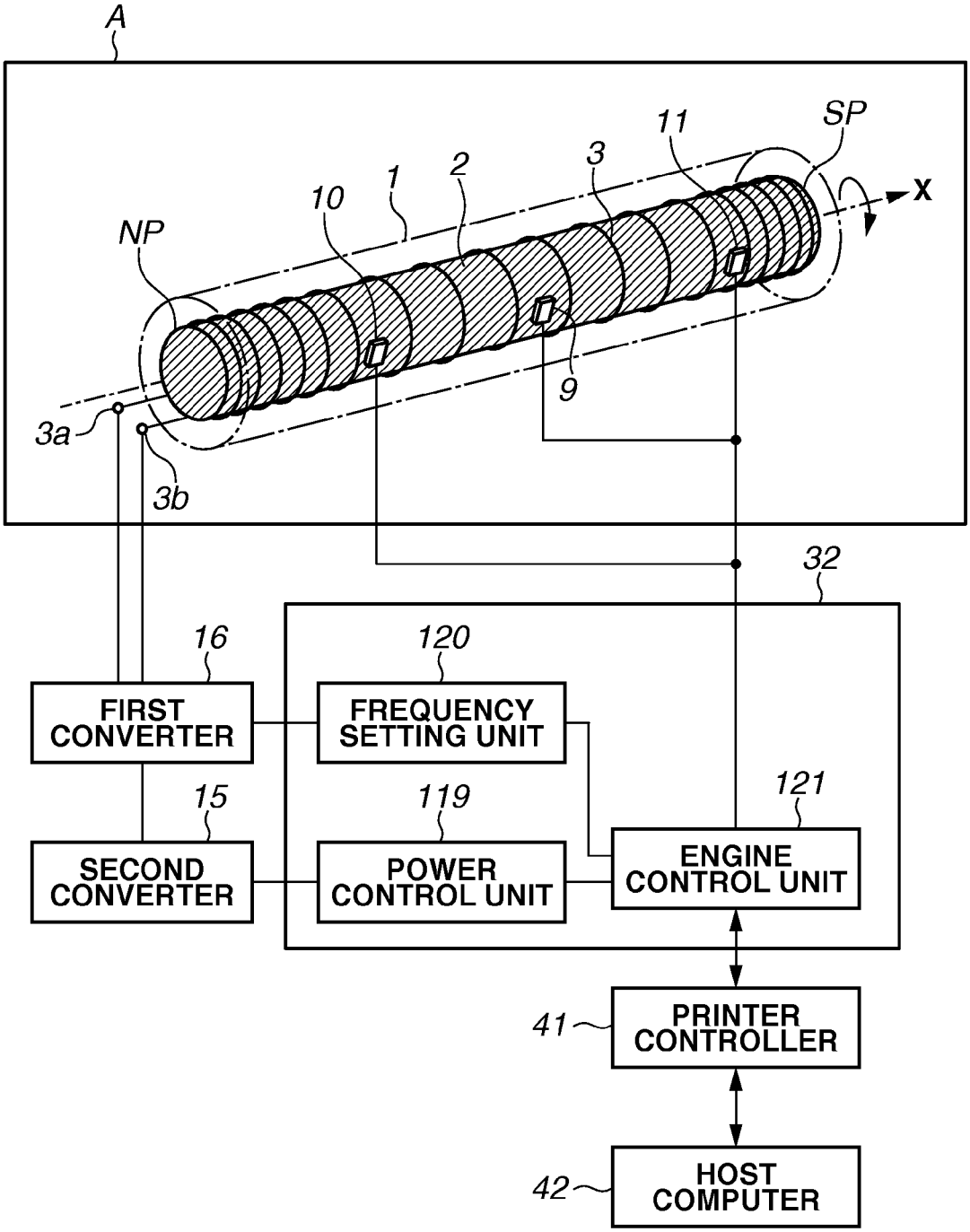
FIG. 4 is a perspective view illustrating a coil unit mounted on the fixing unit and a block diagram of a driving circuit.

The fixing unit A is a fixing apparatus that operates based on the electromagnetic induction heating method. More specifically, the fixing unit A is a fixing apparatus that causes a conductive layer of a rotational member to generate heat by electromagnetic induction with use of a magnetic flux generated by a coil, and fixes the image formed on the recording material P onto the recording material P by the heat of the rotational member. FIG. 2 is a cross-sectional view illustrating the fixing unit A. FIG. 3 is a front view illustrating the fixing unit A. FIG. 4 is a perspective view illustrating a coil unit mounted on the fixing unit A. The fixing unit A includes a heating unit having a fixing sleeve 1 and a coil unit, which will be described below, and a pressing member 8, and forms a fixing nip portion N, where the recording material P bearing the unfixed toner image is conveyed while being held between the heating unit and the pressing member 8.

The pressing roller 8 as the pressing member includes a core metal 8*a*, an elastic layer 8*b* made of silicone rubber or the like, and a release layer 8*c* made of fluorine-contained resin or the like. Both ends of the core metal 8*a* are rotatably held between not-illustrated apparatus chassis of the fixing unit A via bearings. Further, each of pressing springs (compression springs in the present exemplary embodiment) 17*a* and 17*b* is disposed at a position between a different end among both ends of a pressing stay (a metallic reinforcing member) 5 and a corresponding spring bearing member (i.e., a spring bearing member 18*a* or 18*b*) on the apparatus chassis side illustrated in FIG. 3, by which a push-down force is applied to the pressing stay 5. At the fixing unit A according to the present exemplary embodiment, a pressing force of approximately 100 N to 250 N in total (approximately 10 kgf to approximately 25 kgf) is applied to the pressing stay 5. By this configuration, a bottom surface of a sleeve guide member 6 made of thermally-resistant resin (for example, Polyphenylenesulfide (PPS)) and the pressing roller 8 are in pressure contact with each other via the fixing sleeve 1, thereby forming the fixing nip portion N. The pressing roller 8 is driven by a not-illustrated driving unit in a direction indicated by an arrow, and the fixing sleeve 1 rotates by being driven by the rotation of the pressing roller 8. Flange members 12*a* and 12*b* rotate by being driven by the rotation of the fixing sleeve 1. The flange members 12*a* and 12*b* are rotatably disposed at longitudinal ends of the sleeve guide member 6. When the fixing sleeve 1 is displaced toward one side in a generatrix direction during the rotation, the fixing sleeve 1 abuts against the flange member 12*a* or 12*b*, and the flange member 12*a* or 12*b* pushed by the fixing sleeve 1 abuts against a regulating member 13*a* (or 13*b*). As a result, the one-sided displacement of the fixing sleeve 1 is regulated by the regulating member 13*a* or 13*b*. The flange members 12*a* and 12*b* are made of a highly thermally-resistant material, such as a liquid crystal polymer (LCP).

The fixing sleeve 1 as a rotatable cylindrical rotational member desirably have a diameter of 10 to 50 mm. The fixing sleeve 1 includes a heat generation layer (a conductive layer) 1*a* serving as a base layer, an elastic layer 1*b* layered on an outer surface of the heat generation layer 1*a*, and a release layer 1*c* as a front surface of the fixing sleeve 1. The heat generation layer 1*a* is a metallic film (a stainless material for the fixing sleeve 1 in the present exemplary embodiment), and desirably have a film thickness of 10 to 50 μm. The elastic layer 1*b* is made of silicone rubber, and desirably have a hardness of approximately 20 degrees (Japanese Industrial Standards (JIS)-A, under a weight of one kg) and a thickness of 0.1 to 0.3 mm. The release layer 1*c* is a fluorine-contained resin tube, and desirably have a thickness of 10 to 50 μm. An induced current is generated in the heat generation layer 1*a* from an effect of an alternating magnetic flux, which will be described below. The heat generation layer 1*a* generates heat by the induced current, and the heat is transmitted to the elastic layer 1*b* and the release layer 1*c*, whereby the fixing sleeve 1 is heated entirely in a circumferential direction. Temperature detection elements 9, 10, and 11, which detect temperatures of the fixing sleeve 1, will be described below.

A mechanism for generating the induced current in the heat generation layer 1*a* will be described in detail. FIG. 4 is the perspective view illustrating the coil unit mounted on the heating unit. The coil unit includes a coil 3. The coil 3 includes a helical shaped portion disposed inside the rotational member (the fixing sleeve) 1, and having a helix axis extending substantially in parallel with the generatrix direction of the rotational member 1. The coil 3 generates an alternating magnetic field for causing the conductive layer 1*a* of the rotational member 1 to generate the heat by the magnetic induction. Further, the coil unit includes a core 2 disposed inside the helical shaped portion and used to guide the magnetic flux. The core 2 as a magnetic core material is disposed so as to penetrate through a hollow portion of the fixing sleeve 1 with use of a not-illustrated fixation unit. The core 2 has magnetic poles of North Pole (NP) and South Pole (SP). The core 2 is shaped so as to form no loop outside the rotational member 1 (i.e., a shape having an end), and the magnetic flux generated by the coil 3 forms an open magnetic path. The core 2 is desirably formed of a high magnetic permeability material made of a material having a small hysteresis loss and a high relative magnetic permeability, for example, a ferromagnetic oxidized material or alloy including a calcined ferrite, ferrite resin, an amorphous alloy, a permalloy, or the like. According to the present exemplary embodiment, a calcined ferrite having a relative magnetic permeability of 1800 is used for the core 2. The core 2 according to the present exemplary embodiment is cylindrically shaped, and desirably have a diameter of 5 to 30 mm. In a case where the fixing unit A is a fixing apparatus mounted on an A4 printer, a length of the core 2 is desirably approximately 240 mm. The core 2 with the coil 3 wound around it is covered with a resin cover 4.

The energizing coil 3 is formed by placing a single conductive wire in the hollow portion of the fixing sleeve 1, and helically winding the conductive wire around the core 2. The conductive wire is wound in such a manner that an interval is shorter at ends of the core 2 than at a central portion of the core 2. In the case where the core 2 has the longitudinal dimension of 240 mm, the energizing coil 3 is wound eighteen times around the core 2. The interval between the turns thereof is 10 mm at the ends, 20 mm at the central portion, and 15 mm at intermediate portions therebetween. In this manner, the coil 3 is wound in a direction intersecting with an axis X of the core 2.

When a high-frequency current is applied from a high-frequency converter to the energizing coil 3 via power supply contact portions 3*a* and 3*b*, magnetic fluxes are generated. The apparatus according to the present exemplary embodiment is designed in such a manner that most of magnetic fluxes exiting from the end of the core 2 (70% or more, desirably, 90% or more, and further desirably, 94% or more) pass through outside the heat generation layer 1*a* of the fixing sleeve 1 to return to the opposite end of the core 2. Therefore, the induced current flowing in the circumferential direction is generated in the heat generation layer 1*a* of the fixing sleeve 1 in order that a magnetic flux that cancels out the magnetic flux passing through outside the sleeve 1 is generated. As a result, the heat generation layer 1*a* generates the heat entirely in the circumferential direction. In this manner, in the case where the fixing apparatus is configured to cause the induced current to flow in the circumferential direction of the fixing sleeve 1, the fixing sleeve 1 generates the heat over the entire region in the circumferential direction thereof, whereby this configuration has a merit of allowing the fixing apparatus to warm up to a fixable temperature in a reduced time period. Further, the core 2 has the shape having the ends, and is configured in such a manner that most of the magnetic fluxes pass through outside the heat generation layer 1*a* due to the open magnetic path. Therefore, the present exemplary embodiment also has such a merit that the fixing apparatus can be reduced in size compared to an apparatus including a loop-shaped core and configured to form a close magnetic path.

As illustrated in FIG. 2, the temperature detection elements 9, 10, and 11 of the fixing unit A are disposed upstream than the fixing nip portion N in a rotational direction of the fixing sleeve 1, and detect the temperatures of the surface of the fixing sleeve 1. Further, as illustrated in FIG. 3, the temperature detection elements 9, 10, and 11 detect temperatures at a center and both ends of the fixing sleeve 1 in a longitudinal direction of the fixing unit A, respectively. The temperature detection elements 9, 10, and 11 are each embodied by a thermistor or the like. Power supply to the coil 3 is controlled in such a manner that the temperature detected by the temperature detection element 9 at the central portion is maintained at a control target temperature suitable for fixing. Further, each of the temperature detection elements 10 and 11 disposed in the vicinity of the end of the fixing sleeve 1 can detect how much the temperature increases at a sheet non-passing portion of the fixing sleeve 1 when images are successively printed on a small-sized recording material P. Each of the temperature detection elements 10 and 11 may be disposed at the corresponding axial end of the pressing roller 8, and detect how much a temperature increases at a sheet non-passing portion of the pressing roller 8 when the images are successively printed on the small-sized recording material P.

FIG. 4 also includes a block diagram illustrating a relationship among the CPU 32, which is the control unit that controls the printer, a printer controller 41, and a host computer 42. The printer controller 41 performs communication with and receives image data from the host computer 42, and rasterizes the received image data into information that the image forming apparatus 100 can print. Further, the printer controller 41 exchanges a signal and performs serial communication with an engine control unit 121. The engine control unit 121 exchanges the signal with the printer controller 41, and further controls each of the units of the image forming apparatus 100 via serial communication. The engine control unit 121, for example, controls the temperature of the fixing unit A based on the temperatures detected by the temperature detection elements 9, 10, and 11, and also detects an abnormality in the fixing unit A.

Meanwhile, it has been found out that the following issue arises with the fixing apparatus designed in such a manner that most of the magnetic fluxes exiting from the end of the core pass through outside the heat generation layer of the fixing sleeve to return to the opposite end of the core so as to generate the induced current flowing in the circumferential direction of the sleeve in the conductive layer of the sleeve.

Generally, the fixing apparatus that operates based on the electromagnetic induction method is provided with the high-frequency converter that drives a resonance circuit including a coil. Then, in the case where the fixing apparatus employs the method for generating the heat by linking the magnetic flux generated by the coil to the conductive layer of the rotational member and generating an eddy current in the conductive layer, the fixing apparatus adjusts a driving frequency of the high-frequency converter to adjust a heat generation amount so as to keep the temperature of the sleeve constant.

Figure 6:
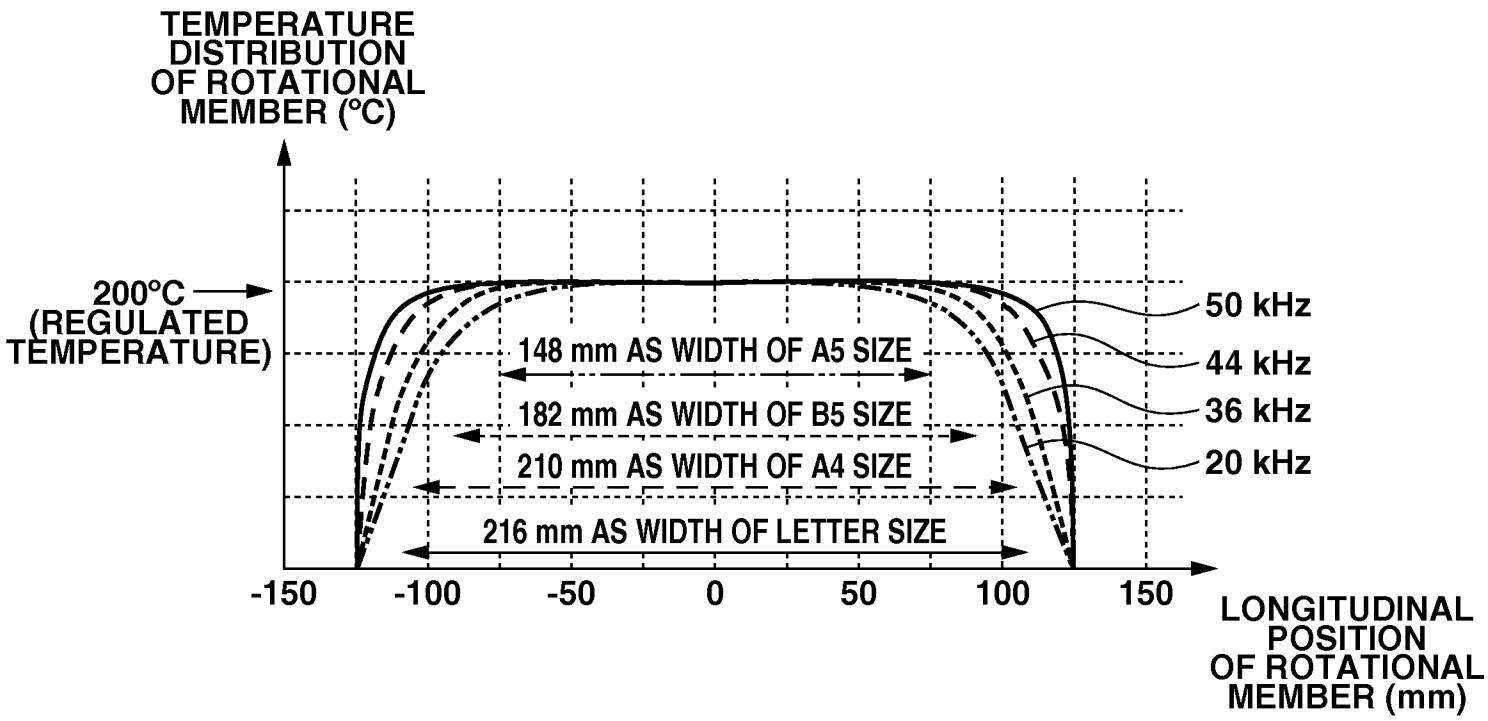
FIG. 6 is a diagram illustrating a relationship between a driving frequency and a temperature distribution of a fixing sleeve.

However, it has been found out that the fixing apparatus that generates the induced current flowing in the circumferential direction of the sleeve, according to the present exemplary embodiment, is subject to a change in a heat generation distribution of the sleeve in the generatrix direction when the driving frequency of the high-frequency converter is changed. FIG. 6 is a diagram illustrating temperature distributions of the sleeve when the driving frequency of the high-frequency converter is changed within a range of 20 kHz to 50 kHz so as to maintain the temperature at the center of the rotational member (the sleeve) in the generatrix direction (the longitudinal direction) at 200° C. This graph reveals that the heat generation amount reduces at the both ends of the sleeve as the driving frequency reduces. Therefore, for example, in a case where the driving frequency should be set to 20 kHz to maintain the temperature at the central portion at 200° C., the heat generation amount falls short at the both ends of the sleeve. As a result, the fixing apparatus fails to completely fix the image on the recording material corresponding to the both ends of the sleeve.

Figure 5:
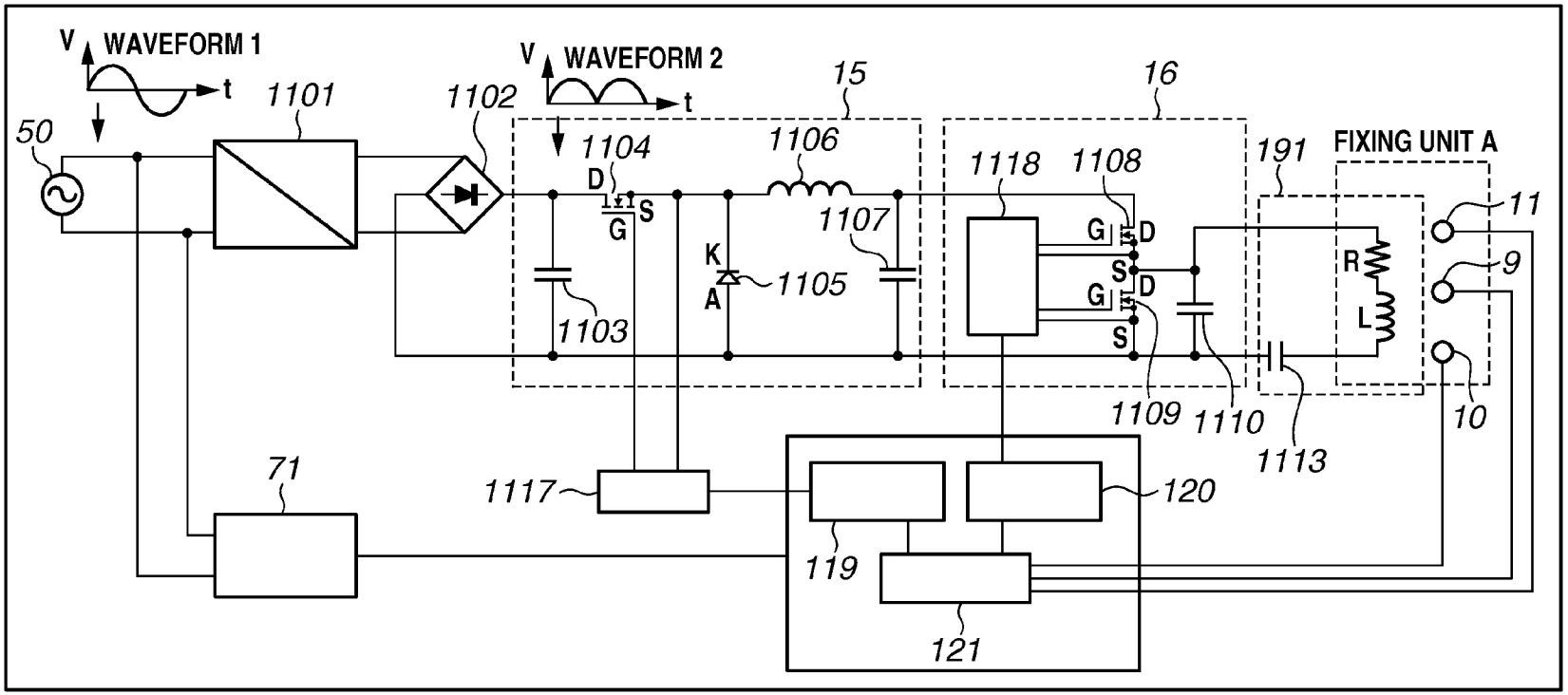
FIG. 5 is a diagram illustrating the driving circuit.

Therefore, according to the present exemplary embodiment, in addition to a high-frequency converter 16 (a first converter) that drives a resonance circuit 191, a second converter 15 is included for controlling power to be supplied to the first converter 16, as illustrated in FIGS. 4 and 5. The resonance circuit 191 includes the cylindrical rotational member 1 having the conductive layer 1*a*, the coil 3 disposed inside the rotational member 1 and having the helix axis extending substantially in parallel with the generatrix direction of the rotational member 1, and a resonance capacitor 1113. It is sufficient that the helix axis of the coil 3 extends along the generatrix direction of the rotational member 1. The resonance circuit 191 illustrated in FIG. 5 has an equivalent resistance R of the fixing unit A and an equivalent inductance L of the fixing unit A. The resonance circuit 191 according to the present exemplary embodiment is a current resonance circuit. Further, there is provided a frequency setting unit 120 that sets the driving frequency of the first converter 16 according to at least one of a size of the recording material P and the temperature at the sheet non-passing portion of the rotational member 1. Furthermore, there is provided a power control unit 119 that controls the second converter 15 according to a temperature at a sheet passing portion of the rotational member 1 to control the power to be supplied from the second converter 15 to the first converter 16. Each of the first converter 16 and the second converter 15 is an inverter that converts a direct current into an alternating current, as narrowly defined.

More specifically, the frequency setting unit 120 sets the driving frequency of the first converter 16 according to the temperature detected by the temperature detection element 10 or 11 so as to prevent an excessive increase in the temperature of the rotational member 1 on a region that is the sheet non-passing portion where a small-sized sheet does not pass through. The power control unit 119 controls output voltage of the second converter 15 so as to maintain the temperature at the sheet passing portion of the rotational member 1 (the temperature detected by the temperature detection element 9) at a control target temperature, which is the fixable temperature. The driving frequency of the first converter 16 may be set according to information about the size of the recording material P.

The driving circuit illustrated in FIG. 5 will be described in detail. A commercial power source (an alternating-current power source) 50 is connected to the image forming apparatus 100, and supplies alternating-current power to the image forming apparatus 100. A waveform of the commercial power source 50 is a waveform shown as a waveform 1, where a horizontal axis and a vertical axis represent a time and a voltage, respectively. The power input from the commercial power source 50 is input into a diode bridge 1102 via an alternating-current (AC) filter 1101, and is subject to full-wave rectification. After being charged in a capacitor 1103, the rectified voltage exhibits a voltage waveform shown as a waveform 2, where a horizontal axis and a vertical axis represent a time and a voltage, respectively.

A power source unit 71 generates a direct-current voltage, and outputs a predetermined voltage to a not-illustrated secondary-side load (a motor, the CPU, and the like).

The first converter 16 will be described. As will be described below, the first converter 16 is connected to an output of the second converter 15. Switching elements 1108 and 1109 form a half-bridge circuit of the first converter 16. A capacitor 1110 is a voltage resonance capacitor and is connected to between a drain (D) and a source (S) of the switching element 1109 (between a collector and an emitter, if the switching element 1109 is an insulated gate bipolar transistor (IGBT)), according to the present exemplary embodiment. A switching element driving circuit 1118 drives the switching elements 1108 and 1109. The resonance circuit 191 is a series resonance (current resonance) circuit having the equivalent inductance L, the equivalent resistance R, and including the current resonance capacitor 1113. The equivalent resistance R corresponds to a resistance of the rotational member 1 and a resistance of the energizing coil 3 that are expressed as a series equivalent resistance from the point of view of the energizing coil 3.

Figure 7:
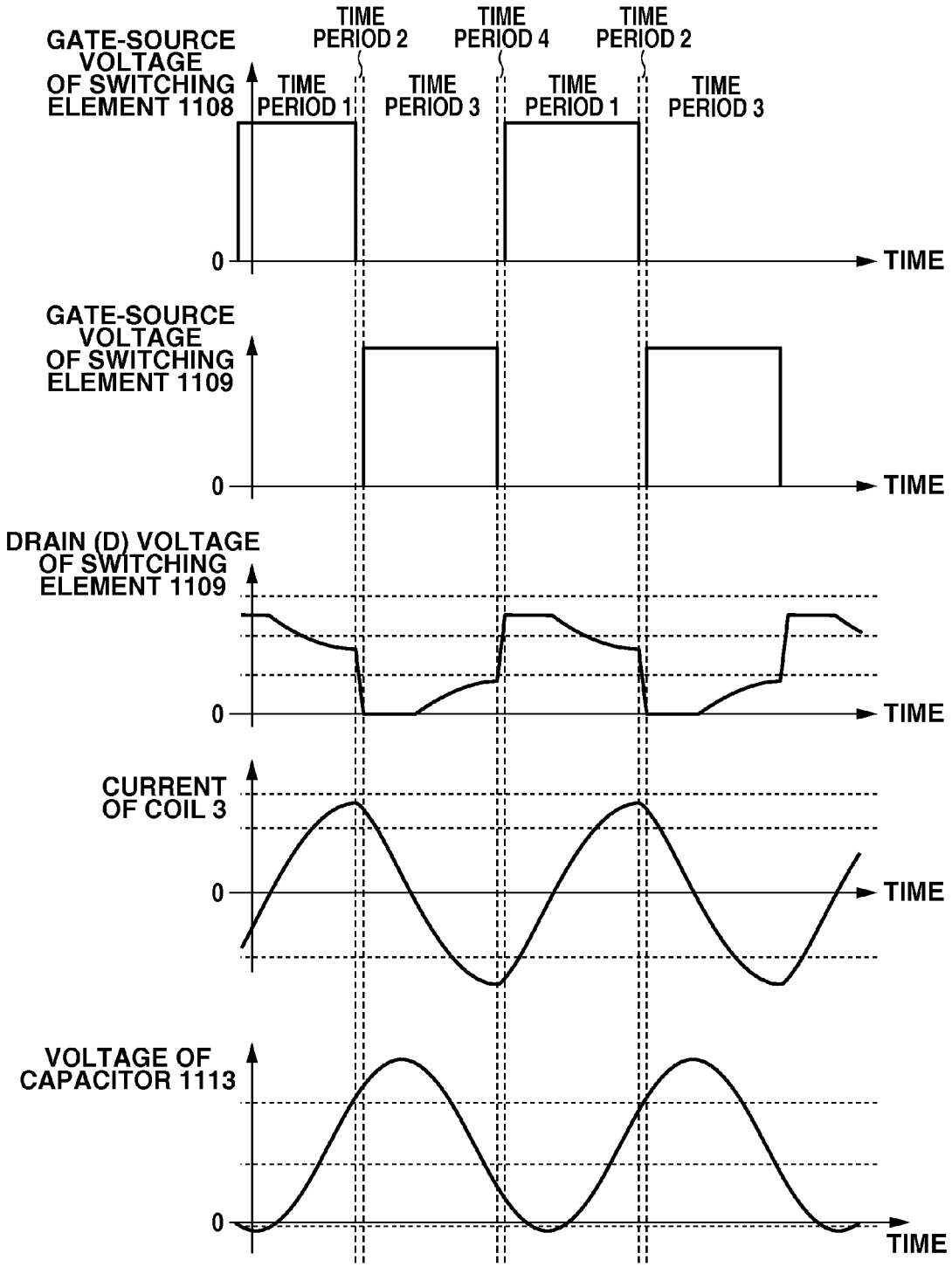
FIG. 7 is a diagram illustrating an operation of a first converter.

FIG. 7 is a diagram illustrating a gate (G)-source (S) voltage of the switching element 1108, a gate (G)-source (S) voltage of the switching element 1109, a drain (D) voltage of the switching element 1109, a current of the coil 3, and a voltage of the capacitor 1113. Because of the use of the current resonance circuit, both the switching elements 1108 and 1109 are alternately driven at a duty ratio of approximately 50% in terms of a time period 1+a time period 2+a time period 3+a time period 4. More specifically, a time period during which the switching element 1108 is turned on is the time period 1, and a ratio of the time period 1 is (the time period 1/(the time period 1+the time period 2+the time period 3+the time period 4))≈50%. A time period during which the switching element 1109 is turned on is the time period 3, and a ratio of the time period 3 is (the time period 3/(the time period 1+the time period 2+the time period 3+the time period 4))≈50%. The switching elements 1108 and 1109 are driven at the duty ratio of 50%, because half the voltage input into the first converter 16 should be charged in the current resonance capacitor 1113. In a case where the switching elements 1108 and 1109 are not driven at the duty ratio of 50%, this results in a reduction in a voltage amplitude allowable in the current resonance capacitor 1113, and thus the power that can be output to the coil 3 is reduced. Further, a dead time is necessarily provided as a time period during which the switching elements 1180 and 1109 are turned off at the same time (the time period 2 and the time period 4 illustrated in FIG. 7) to prevent both the switching elements 1108 and 1109 from being conductive.

The capacitor 1110 is connected to between the drain (D) terminal and the source (S) terminal of the switching element 1109. When the switching element 1108 is turned on and the current flows from the capacitor 1107, a voltage of the capacitor 1110 becomes substantially equal to a voltage of the capacitor 1107. After that, the current starts flowing in the energizing coil 3 and the capacitor 1113 in the fixing unit A (the time period 1 illustrated in FIG. 7). The current flowing in the coil 3 and the capacitor 1113 has a sinusoidal waveform. The switching element 1108 is turned off while the current from the coil 3 is charging the capacitor 1113. Because the current is kept urged to flow in the energizing coil 3 continuously, the current flows in the capacitor 1113 and a not-illustrated reverse conducting diode included in the switching element 1109 (the time period 2 illustrated in FIG. 7).

The drain (D) voltage of the switching element 1109 becomes lower than a source (S) voltage of the switching element 1109 by a degree corresponding to a forward voltage of the reverse conducting diode. The frequency setting unit 120 turns on the switching element 1109 via the switching element driving circuit 1118 while the reverse conducting diode of the switching element 1109 is conducting the current during the time period 2 illustrated in FIG. 7. The current flowing in the energizing coil 3 reduces over time. The voltage stored in the capacitor 1113 is maximized, and the current starts flowing in a reverse direction after that (the time period 3 illustrated in FIG. 7).

The switching element 1109 is turned off before the current flowing in the reverse direction reaches 0 A. Then, the flowing current starts charging the capacitor 1110, and the drain (D) voltage of the switching element 1109 increases (the time period 4 illustrated in FIG. 7). When the drain (D) voltage of the switching element 1109 becomes higher than the voltage of the capacitor 1107, the current starts flowing in a not-illustrated reverse conducting diode included in the switching element 1108.

The voltage of the capacitor 1110 is a sum of the voltage of the capacitor 1107 and the forward voltage of the not-illustrated reverse conducting diode included in the switching element 1109. The frequency setting unit 120 turns on the switching element 1108 via the switching element driving circuit 1118 while the current is flowing in the reverse conducting diode of the switching element 1108 (the time period 1 illustrated in FIG. 7). After that, the frequency setting unit 120 repeats the above-described switching control from the time period 1 to the time period 4.

In this manner, the switching elements 1108 and 1109 achieve a soft switching operation, whereby high efficiency can be maintained, by appropriate settings of a capacity of the voltage resonance capacitor 1110, the current when the switching element 1108 or 1109 is turned off, and the time period of the dead time (the time period 2 and the time period 4).

Figure 8:
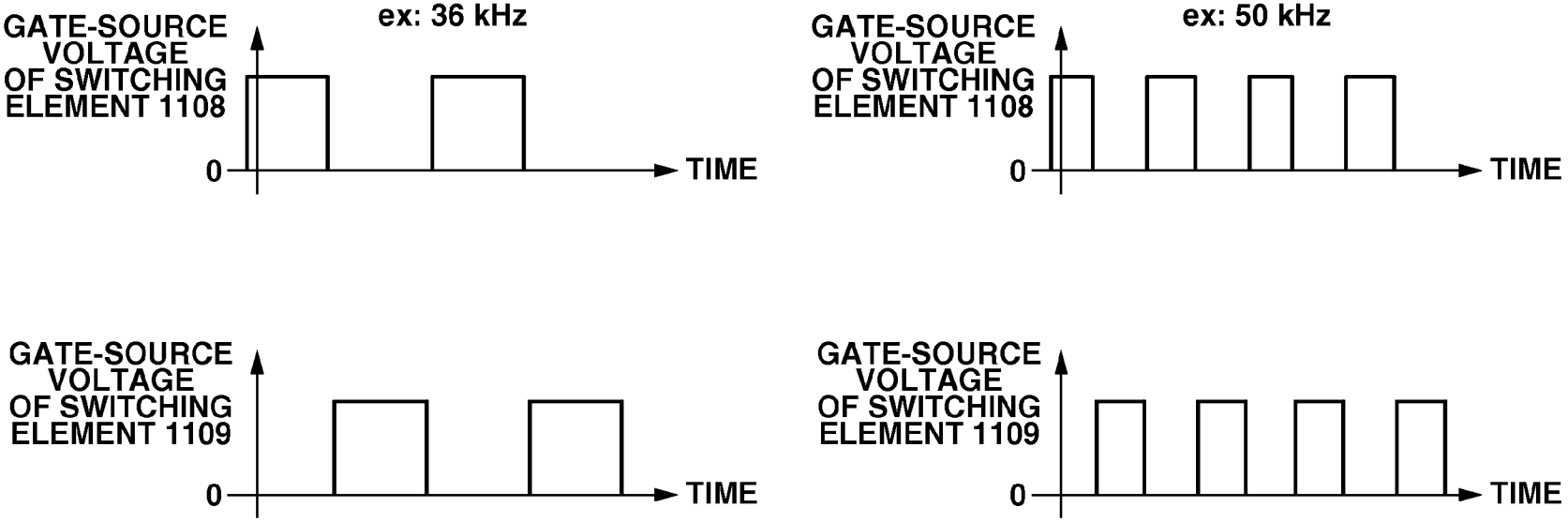
FIG. 8 is a diagram illustrating an operation of the first converter when the driving frequency is switched.

A switching frequency (the driving frequency) of the current resonance circuit 191 is controlled by the frequency setting unit 120. The frequency setting unit 120 controls the driving frequency of the resonance circuit 191 based on the temperature detected by the temperature detection element 10 or 11 disposed on the region of the rotational member 1 where the recording material P does not pass through (the sheet non-passing portion). The sheet non-passing portion means a region where a recording material having a largest size usable in the apparatus passes through but a recording material having a smaller size than the largest size does not pass through. For example, when the temperature detected by the temperature detection element 10 or 11 reaches a predetermined upper limit temperature, the driving frequency of the resonance circuit 191 is reduced, so that the heat generation at the sheet non-passing portion of the rotational member 1 is reduced to limit the temperature increase at the sheet non-passing portion. In this manner, the heat generation distribution suitable for the size of a recording material is established. FIG. 8 is a diagram illustrating waveforms of the gate (G)-source (S) voltages of the switching elements 1108 and 1109 when the driving frequency is set to 36 kHz and 50 kHz. The ON duty ratio of the switching element 1108 and the ON duty ratio of the switching element 1109 are approximately 50% for both of the driving frequencies. By switching the driving frequency of the first converter 16 in this manner, the heat generation distribution suitable for the size of a recording material can be established, like the heat generation distribution illustrated in FIG. 6. According to the present exemplary embodiment, the driving frequency is controlled in such a manner that the temperatures detected by the temperature detection elements 10 and 11 do not exceed the upper limit temperature, whereby the driving frequency may be changed while a single recording material is being processed by the fixing processing. On the other hand, in a case where the temperature detection elements 10 and 11 are not provided, and the driving frequency of the resonance circuit 191 is set according to the information about the size of a recording material, the above-described effect can be achieved by setting a predetermined driving frequency for each size of a recording material. This configuration will be described in a second exemplary embodiment.

An operation of the second converter 15 will be described. The second converter 15 is provided to control the power to be supplied to the first converter 16, and controls the power to be supplied to the first converter 16 according to the temperature at the sheet passing portion of the rotational member 1 where the recording material P passes through (the temperature detected by the temperature detection element 9) regardless of the size of the recording material P. More specifically, the power control unit 119 transmits a signal to the driving circuit 1117 according to the temperature detected by the temperature detection element 9 to control an ON duty ratio of a switching element 1104. As a result, the power to be supplied to the first converter 16 (the output voltage of the second converter 15) is controlled.

The second converter 15 includes the switching element 1104, a diode 1105, a coil 1106, the capacitor 1107, and the like, and is a voltage step-down converter. A voltage is applied to between a gate (G) and a source (S) of the switching element 1104, and the voltage is applied to the coil 1106 when the switching element 1104 is turned on. A difference voltage between voltages of the capacitor 1103 and the capacitor 1107 is applied to both ends of the coil 1106. A slope of a current flowing in the coil 1106 is determined by an inductance of the coil 1106 and the voltage applied to the coil 1106.

The current passed through the coil 1106 charges the capacitor 1107. As the voltage of the capacitor 1107 increases, the voltage applied to the coil 1106 reduces even when the switching element 1104 is turned on. In this manner, the current flowing in the coil 1106 is changed according to the voltage applied to the coil 1106, but the current flowing in the coil 1106 approximately linearly increases if the voltage of the capacitor 1107 increases slowly. This time period is a time period 1 illustrated in FIG. 9.

Turning off the switching element 1104 brings about such a state that the current continuously flows to the coil 1106 via the diode 1105. The capacitor 1107 is charged by power that is stored in the coil 1106 in the form of a magnetic field. If a capacity of the capacitor 1107 is sufficiently large, the current of the coil 1106 reduces with a substantially linear characteristic line. If the current is flowing in the coil 1106 when the switching element 1104 is turned on, a current value at the time is an initial value when the switching element 1104 is turned on. The second converter 15 functions by repeating the above-described series of operations.

Pulse width modulation (PWM) control is used for a method for driving the switching element 1104. The power control unit 119 increases an ON time ratio of the PWM, i.e., the ON duty ratio (the time period 1/(the time period 1+a time period 2) illustrated in FIG. 9), when it is desired to increase the output power of the second converter 15 so as to maintain the temperature at the sheet passing portion of the rotational member 1 at the control target temperature. Conversely, the power control unit 119 reduces the ON duty ratio when it is desired to reduce the output power of the second converter 15.

Figure 9:
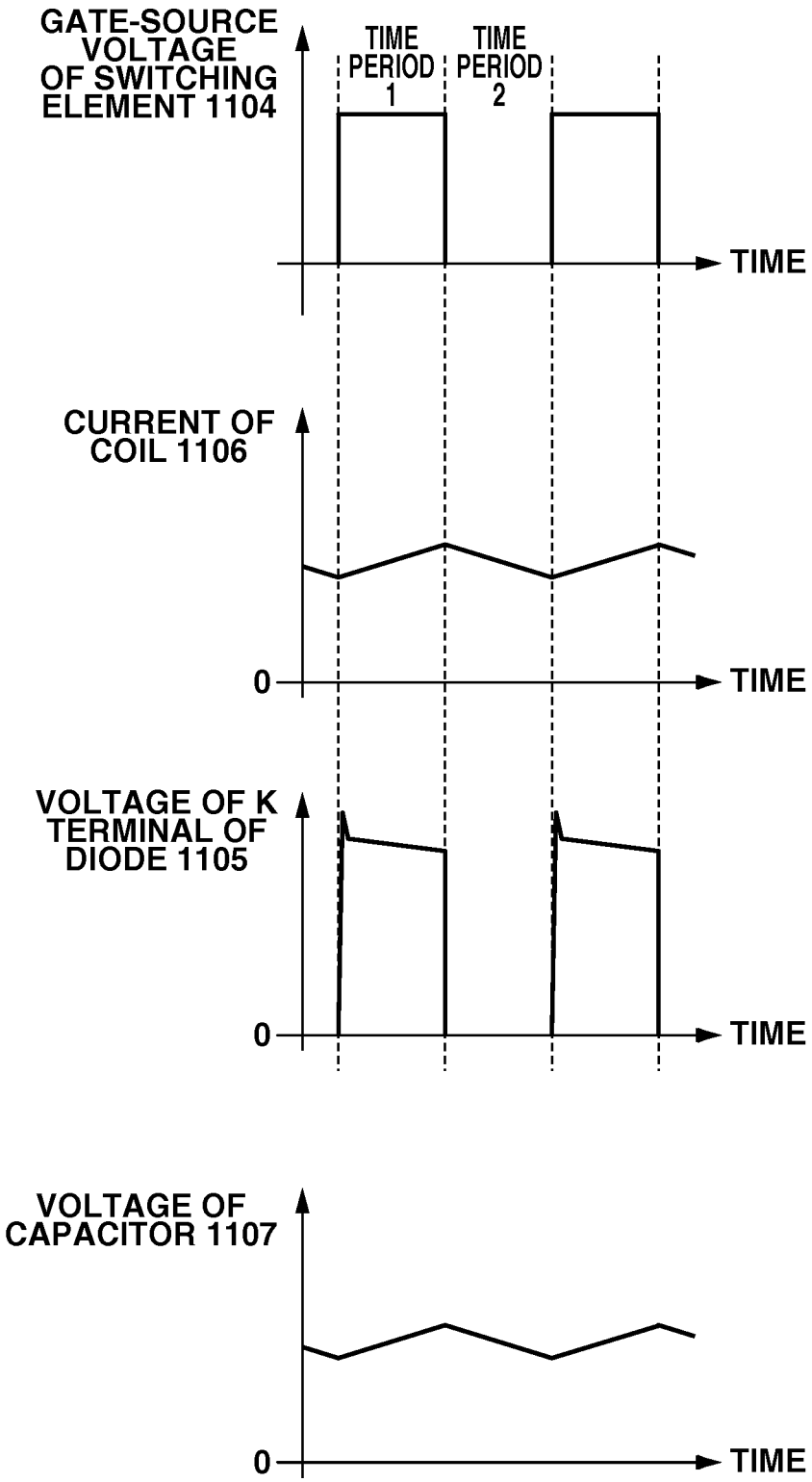
FIG. 9 is a diagram illustrating an operation of a second converter.

In the PWM control, the current flowing in the coil 1106 never falls to zero. FIG. 9 is a diagram illustrating the current of the coil 1106 and a voltage of a K terminal of the diode 1105 when the PWM control is performed. In this manner, the switching element 1104 functions as hard switching, in which a turn-on operation and a turn-off operation are performed while the current is flowing. The voltage of the capacitor 1107 illustrated in FIG. 9 corresponds to the output voltage of the second converter 15.

Figure 10:
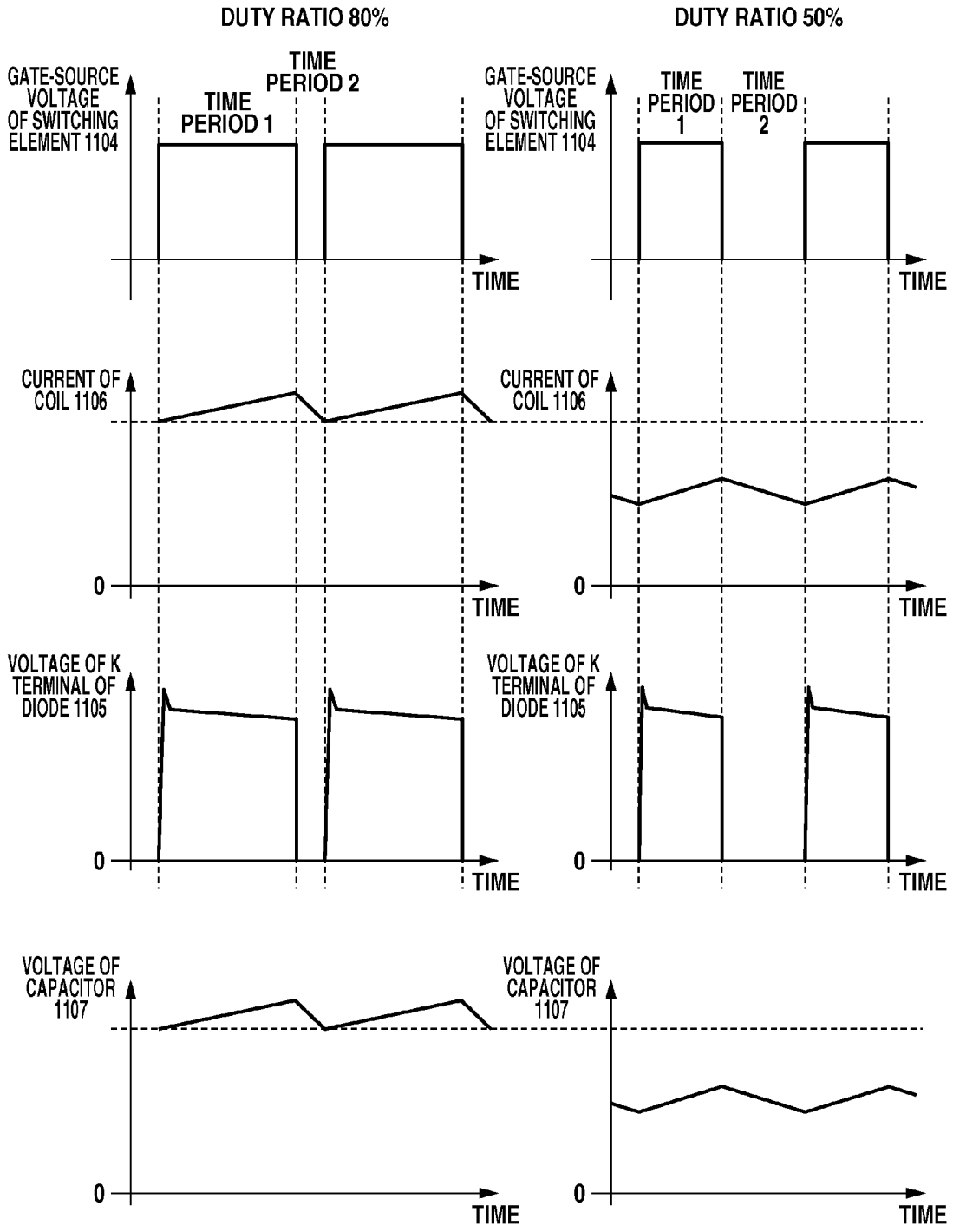
FIG. 10 is a diagram illustrating an operation of the second converter when an ON duty ratio of a switching element in the second converter is switched.

FIG. 10 is a diagram illustrating a comparison between when the ON duty ratio is set to 80% and when the ON duty ratio is set to 50%. As illustrated in FIG. 10, a change in the ON duty ratio leads to a change in the voltage of the capacitor 1107, and thus the output voltage of the second converter 15 is changed. This results in a change in the power supplied to the first converter 16.

A noise may be created depending on a timing at which the switching element 1104 is turned on and off. In such a case, a critical mode, in which the switching element 1104 is kept turned off until the current flowing in the coil 1106 reaches 0 A while the switching element 1104 is turned off, may be used.

Because the source (S) terminal of the switching element 1104 is a contact point between the coil 1106 and the diode 1105, the voltage here becomes equivalent to a voltage of a negative-side terminal of the capacitor 1103 when the switching element 1104 is turned off. This voltage becomes equivalent to a voltage of a positive-side terminal of the capacitor 1103 when the switching element 1104 is turned on. In this manner, the switching element 1104 is subject to a large change in the source (S) voltage, which necessitates driving by transformer coupling or use of a not-illustrated bootstrap circuit to maintain continuous supply of the voltage to between the gate (G) and the source (S) of the switching element 1104.

The switching element 1104 is connected to the commercial alternating-current power source 50 without being insulated therefrom. The present exemplary embodiment is configured to secure insulation by the driving circuits 1117 and 1118 by way of example, to allow this configuration to be applied to an apparatus requiring insulation in compliance with a safety standard.

In the manner as described above, the power control unit 119 controls the ON duty ratio of the above-described PWM control based on the temperature detected by the temperature detection element 9. Proportional-Integral (PI) control, Proportional-Integral-Derivative (PID) control, or the like is used as a control method therefor. Then, the power control unit 119 drives the driving circuit 1117 to control the ON duty ratio of the switching element 1104 so as to maintain the temperature detected by the temperature detection element 9 at the control target temperature, which is the fixable temperature. The change in the ON duty ratio of the switching element 1104 leads to the change in the voltage of the capacitor 1107, and thus the power supplied to the first converter 16 is changed.

According to the present exemplary embodiment, the output voltage of the second converter 15 is controlled, instead of controlling the driving frequency of the first converter 16, to maintain the temperature at the sheet passing portion (the temperature detected by the temperature detection element 9) at the control target temperature.

Figure 11:
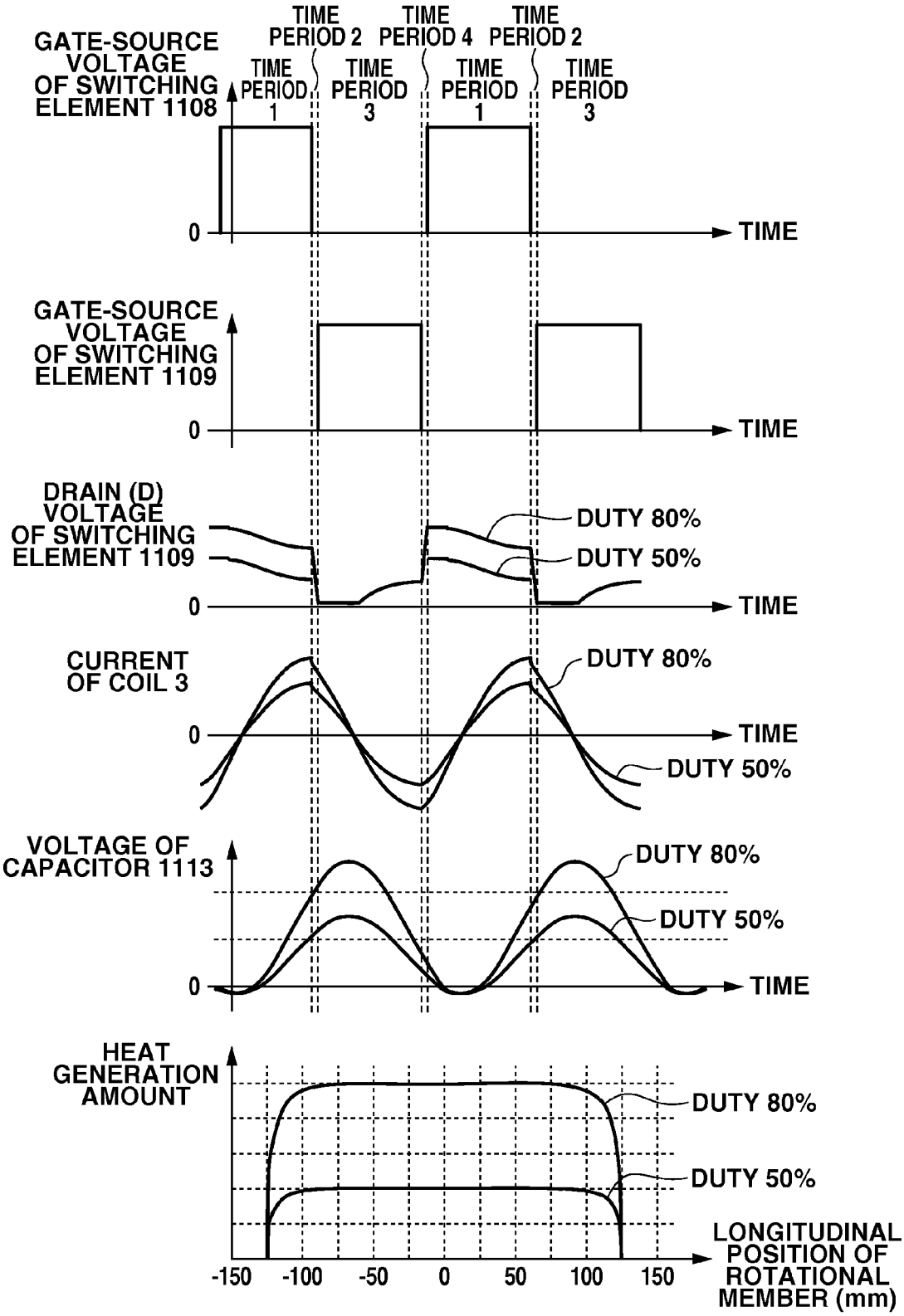
FIG. 11 is a diagram illustrating a difference in a heat generation amount of a rotational member when the ON duty ratio of the switching element in the second converter is switched.

FIG. 11 is a diagram illustrating a comparison between the heat generation amount of the rotational member 1 when the ON duty ratio of the switching element 1104 of the second converter 15 is set to 80%, and the heat generation amount of the rotational member 1 when this ON duty ratio is set to 50%. As described above, the frequency setting unit 120 sets the driving frequency of the first converter 16 according to the temperature detected by the temperature detection element 10 or 11 that detects the temperature at the sheet non-passing portion of the rotational member 1, by which the heat generation distribution of the rotational member 1 in the generatrix direction is adjusted. Then, the power control unit 119 controls the output voltage of the second converter 15 according to the temperature detected by the temperature detection element 9 that detects the temperature at the sheet passing portion, by which the control for keeping the temperature at the sheet passing portion constant is performed. The voltage of the capacitor 1113 is different between when the ON duty ratio of the second converter 15 is set to 80% and when the ON duty ratio of the second converter 15 is set to 50%, as shown in FIG. 11. The heat generation amount of the rotational member 1 is adjusted with use of this difference in the voltage.

In the manner as described above, according to the present exemplary embodiment, the driving frequency of the first converter 16 is set according to the temperature at the sheet non-passing portion of the rotational member 1, and controls the output voltage of the second converter 15 according to the temperature at the sheet passing portion of the rotational member 1. This allows the temperature at the sheet passing portion to be maintained at the control target temperature while the heat generation distribution of the rotational member 1 is kept adjusted to the heat generation distribution according to the size of the recording material P.

As will be described in detail in the second exemplary embodiment, the driving frequency of the first converter 16 may be set according to the size of the recording material P, instead of being set according to the temperature at the sheet non-passing portion. The above-described effect can be achieved by setting the driving frequency of the first converter 16 according to at least either of the size of the recording material P and the temperature at the sheet non-passing portion of the rotational member 1.

Further, an effective value of the voltage to be input into the first converter 16 may be adjusted by disposing a switching element, such as a triac, on an input side of the diode bridge 1102 without disposing the second converter 15, and performing phase control or wave number control on this element. Further, the effective value of the voltage to be input into the first converter 16 may be adjusted by disposing a switching element, such as a field-effect transistor (FET) and an IGBT on an output side of the diode bridge 1102, and performing the phase control or the wave number control on this element.

According to the present exemplary embodiment, the voltage is output from the second converter 15 according to the ON duty ratio of the switching element 1104 of the second converter 15 in a relationship expressed by the following expression;

$$\text{output voltage} = \text{input voltage} \times \text{ON duty ratio} \quad (1).$$

Figure 13:
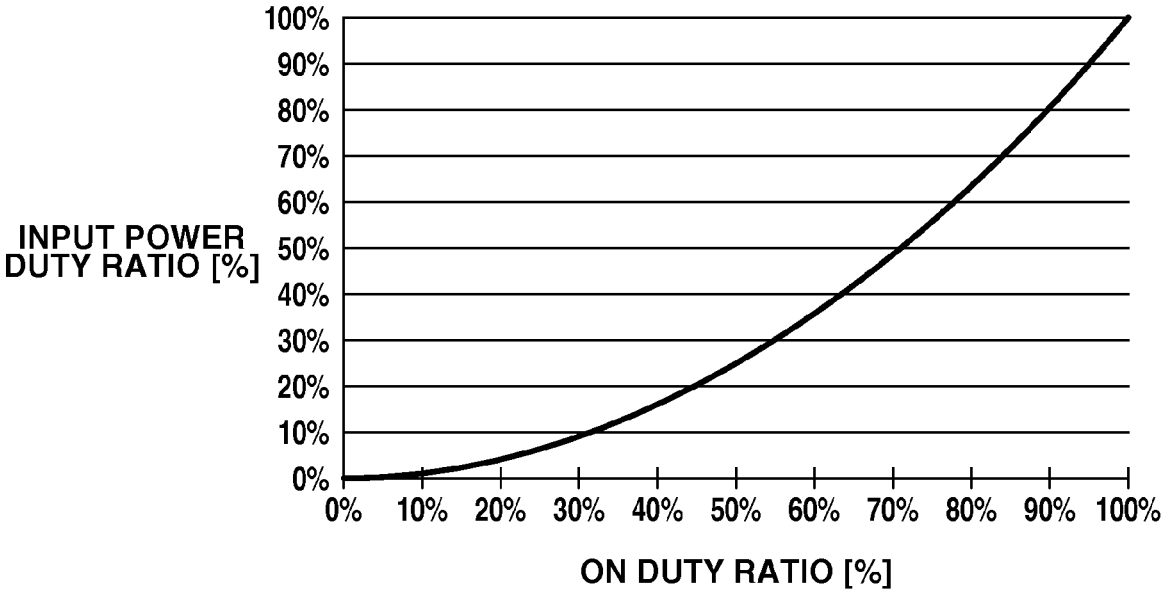
FIG. 13 is a diagram illustrating a relationship between an ON duty ratio and an input power duty ratio.

Further, in the apparatus according to the present exemplary embodiment, a relationship as illustrated in FIG. 13 is established between an input power duty ratio of the power input into the first converter 16 and the ON duty ratio of the switching element 1104 of the second converter 15.

The driving frequency of the first converter 16 is changed according to at least either of the size of the recording material P and the temperature at the sheet non-passing portion of the rotational member 1 as described above, but the change in the driving frequency of the first converter 16 leads to a change in input power supplied to the fixing unit A. For example, when images are successively printed on the plurality of recording material P, the temperature increases at the sheet non-passing portion, which may raise the necessity of changing the driving frequency of the first converter 16 in the middle of the successive printing in some cases. However, the change in the driving frequency in the middle of the successive printing leads to the change in the input power supplied to the fixing unit A, whereby the temperature of the fixing unit A is destabilized and thus fixability of the image is affected.

Figure 14A:
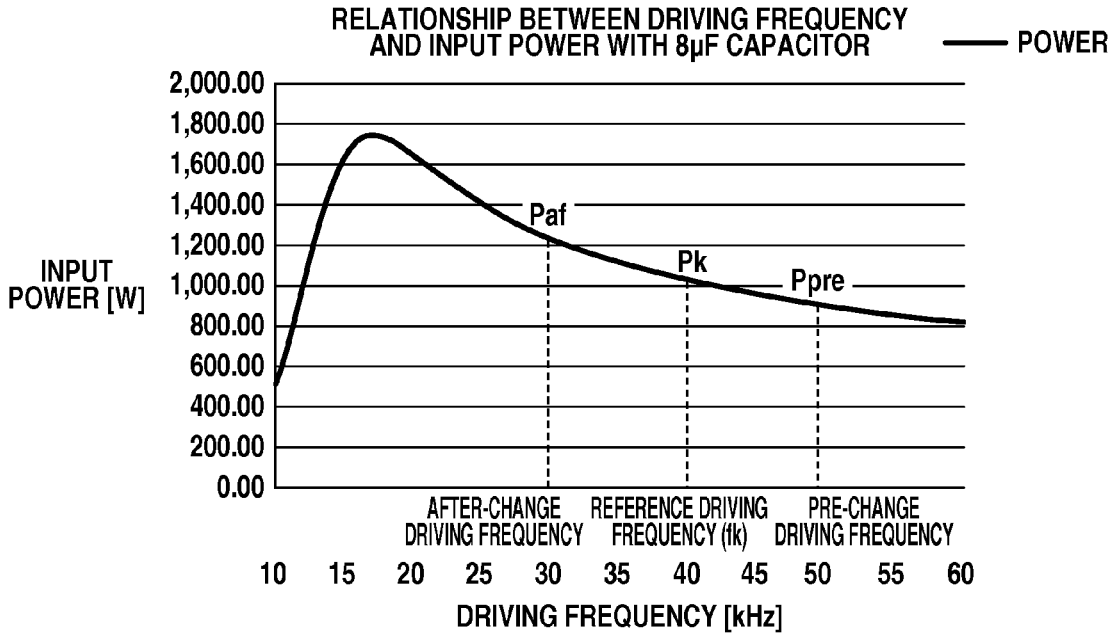
FIGS. 14A, 14B, and 14C are diagrams illustrating a relationship between the driving frequency and input power, and how the input power duty ratio is changed.

FIG. 14A is a graph illustrating a relationship between the driving frequency of the first converter 16 and the input power supplied to the fixing unit A. This graph indicates the relationship when a constant voltage is input into the first converter 16 (with the input power duty ratio set to 100%), and a horizontal axis and a vertical axis represent the driving frequency of the first converter 16 and the input power supplied to the fixing unit A, respectively. The characteristic line illustrated in FIG. 14A can be derived from the following expression;

$$P = \frac{V^2 * R}{\sqrt{R^2 + \left(2\pi f * L - \frac{1}{2\pi f * C}\right)^2}}, \quad (2)$$

where P represents the input power supplied to the fixing unit A, V represents the input power supplied to the first converter 16, R represents a resistance value of the equivalent resistance of the fixing unit A (refer to FIG. 5), f represents the driving frequency of the first converter 16, L represents the equivalent inductance of the fixing unit A, and C represents the capacity of the resonance capacitor 1113.

Figure 14B:
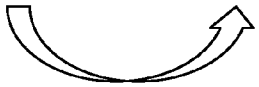

As illustrated in FIG. 14A, it is revealed that the change in the driving frequency of the first converter 16 leads to the change in the input power to be supplied to the fixing unit A, even if the power input into the first converter 16 kept the same. As illustrated in FIG. 14B, power of 900 W×80%=720 W is input into the fixing unit A when the driving frequency of the first converter 16 is set to 50 kHz and the input power duty ratio of the second converter 15 is set to 80%. If the driving frequency of the first converter 16 is switched to 32 kHz without changing the input power duty ratio from this state, the input power to be supplied to the fixing unit A increases to 1250 W×80%=1000 W. Therefore, a measure for preventing or reducing the change in the power input into the fixing unit A should be taken to prevent or reduce the change in the temperature of the fixing unit A (the change in the temperature of the rotational member 1) when the heat generation distribution is adjusted by changing the driving frequency of the first converter 16.

Therefore, the power control unit 119 according to the present exemplary embodiment controls the second converter 15 according to the temperature at the sheet passing portion of the rotational member 1 and the driving frequency of the first converter 16 to control the power to be supplied from the second converter 15 to the first converter 16. More specifically, the power to be input into the fixing unit A is corrected (the input power duty ratio is corrected) based on the characteristic expressed by the expression (2), when the driving frequency of the first converter 16 is switched. As illustrated in FIG. 13, according to the present exemplary embodiment, the input power (the input power duty ratio) is changed by changing the ON duty ratio of the second converter 15. In the following description, a method for correcting the power to be input into the fixing unit A will be described.

Assume that Ppre represents the input power when the first converter 16 is driven with the driving frequency before the driving frequency is changed. On the other hand, assume that Paf represents the input power when the first converter 16 is driven with the driving frequency after the driving frequency is changed. Each of Ppre and Paf indicates the input power of the corresponding driving frequency illustrated in FIG. 14A. Assume that Dpre represents the input power duty ratio before the driving frequency of the first converter 16 is changed, and Daf represents the input power duty ratio after the driving frequency is changed, which is set in such a manner that the input power matches the input power before the driving frequency of the first converter 16 is changed. The input power duty ratio Daf after the driving frequency is changed can be expressed by the following expression;

$$Daf = Ppre/Paf * Dpre \quad (3).$$

Figure 14C:
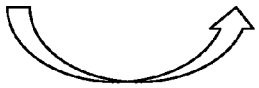

The engine control unit 121 recognizes Dpre, and can calculate Ppre and Paf from the expression (2). FIG. 14C illustrates an example in which the input power is also corrected when the driving frequency is changed. In the example illustrated in FIG. 14C, Dpre is 80%, and Daf can be obtained to be 58% by calculating Ppre of when the driving frequency is 50 kHz and Paf of when the driving frequency is 32 kHz, and substituting them into the expression (3). Therefore, the input power supplied to the fixing unit A can be maintained at 720 W even when the driving frequency of the first converter 16 is switched from 50 kHz to 32 kHz.

According to the present exemplary embodiment, Ppre and Paf are calculated from the expression like the expression (2), but an input power table indicating input power for each driving frequency, as illustrated in FIG. 14A, may be prepared in the engine control unit 121 in advance, and Daf may be acquired with use of the table.

Figure 15:
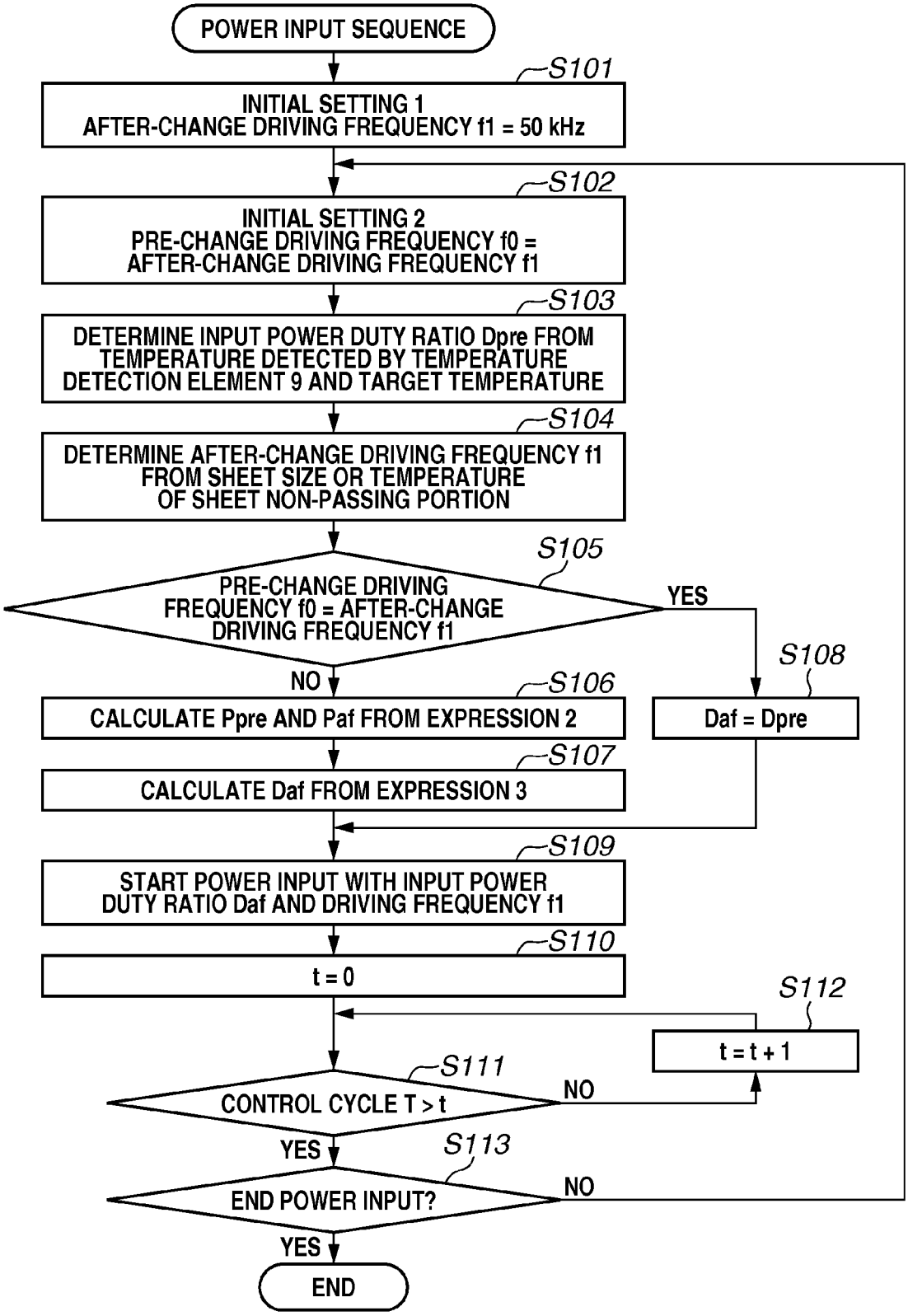
FIG. 15 is a flowchart illustrating a processing procedure according to a first exemplary embodiment.

FIG. 15 is a flowchart illustrating a power input sequence adopting the correction of the input power duty ratio according to the present exemplary embodiment. In step S101, the driving frequency is temporarily set to f1=50 kHz (hereinafter, f1 will be described as a driving frequency after the driving frequency is switched and changed) as an initial setting 1. In step S102, the temporarily set driving frequency f1=50 kHz is replaced with f0 (hereinafter, f0 will be described as a driving frequency before the driving frequency is switched and changed), as an initial setting 2. In step S103, the input power duty ratio Dpre of the power input from the second converter 15 is determined, the input power duty ratio Dpre of the power input from the second converter 15 being of when the first converter 16 is driven with the driving frequency f0, which allows the temperature of the fixing unit A to be maintained at the target temperature by the PID control or the like, from the temperature detected by the temperature detection element 9 and the target temperature. As a result, it becomes possible to clarify the power required to maintain the temperature of the fixing unit A at the target temperature when the driving frequency of the first converter 16 is the driving frequency f0.

In step S104, the after-change driving frequency f1 is determined according to the size of the recording material P or the temperature detected by the temperature detection element 10. Subsequently, in step S105, whether the driving frequency of the first converter 16 should be changed is determined by comparing the driving frequencies f0 and f1. If f0≠f1, so that the driving frequency should be changed (NO in step S105), the processing proceeds to step S106. In step S106, Ppre and Paf are calculated from the expression (2). In step S107, the after-change input power duty ratio Daf is calculated. In steps S106 and S107, the input power duty ratio Daf of when the driving frequency is switched to the driving frequency f1 is calculated in such a manner that the input power matches the input power of when the input power duty ratio is set to the input power duty ratio Dpre calculated in step S103.

On the other hand, if f0=f1 as a result of the comparison in step S105 (YES in step S105), it is determined not to change the driving frequency. Then, in step S108, Daf is replaced with Dpre. In step S109, inputting the power is started with the input power duty ratio of the second converter 15 set to Daf, and the driving frequency of the first converter 16 set to f1. The power control unit 119 drives the switching element 1104 of the second converter 15 according to the input power duty ratio Daf to adjust the effective voltage to be input into the first converter 16. In the power input sequence according to the present exemplary embodiment, the input power is updated according to the temperature detected by the temperature detection element 9 for each period of one cycle of the alternating-current waveform (a frequency of 50 Hz or 60 Hz) of the commercial power source 50 (a control cycle or an update cycle). Further, whether the timing of updating the input power has come is determined by counting the number of half waves (=½ cycles) of the alternating-current waveform of the commercial power source 50 with use of a counter t. In step S110, the counter t is reset. In a case where the counter t does not reach the control cycle (the cycle for updating the duty ratio Daf) T in step S111 (NO in step S111), in step S112, the counter t is incremented. In a case where the counter t reaches or exceeds the control cycle T in step S111 (YES in step S111), and if inputting the power is continued in step S113 (NO in step S113), Daf and f1 is calculated for the next control cycle T, and inputting the power is continued. In a case where inputting the power is stopped in step S113 (YES in step S113), the present sequence is ended. The control cycle T of the power does not necessarily have to be one cycle of the alternating-current waveform of the commercial power source 50, and may be two or more cycles.

In this manner, the input power duty ratio of the power input from the second converter 15 is changed from Dpre to Daf at the timing of when the driving frequency of the first converter 16 is switched. This control allows the image forming apparatus 100 to prevent or reduce a temperature ripple, which would otherwise occur on the fixing unit A, while preventing or reducing the increase in the temperature at the sheet non-passing portion when the small-sized recording material P is processed by the fixing processing.

According to the first exemplary embodiment, the input power duty ratio Daf is calculated in such a manner that the input power after the driving frequency is changed becomes substantially equal to the input power before the driving frequency is changed.

A configuration that sets the input power duty ratio Daf so as to keep the input power constant regardless of the driving frequency will be described as an exemplary modification of the first exemplary embodiment. By this setting, the present exemplary modification allows the input power to be unchanged or less changed even when the driving frequency of the first converter 16 is changed. Assuming that a driving frequency corresponding to input power serving as a reference (a target) is a reference driving frequency fk, the present exemplary modification calculates the input power duty ratio Daf corresponding to the driving frequency f1, from the input power corresponding to the reference driving frequency fk and the input power corresponding to the driving frequency f1 with which the first converter 16 is actually driven.

Assume that Pk represents the power corresponding to the reference driving frequency fk, and P represents the power corresponding to the driving frequency f1. Further, assume that Dk represents the input power duty ratio corresponding to the reference driving frequency fk, and Daf represents the input power duty ratio corresponding to the driving frequency f1 that is calculated in such a manner that the power matches the power Pk. The input power duty ratio Daf can be expressed by the following expression;

$$Daf=Pk/P*Dk \quad (4).$$

The power Pk and the power P can be calculated from the expression (2).

Figure 16:
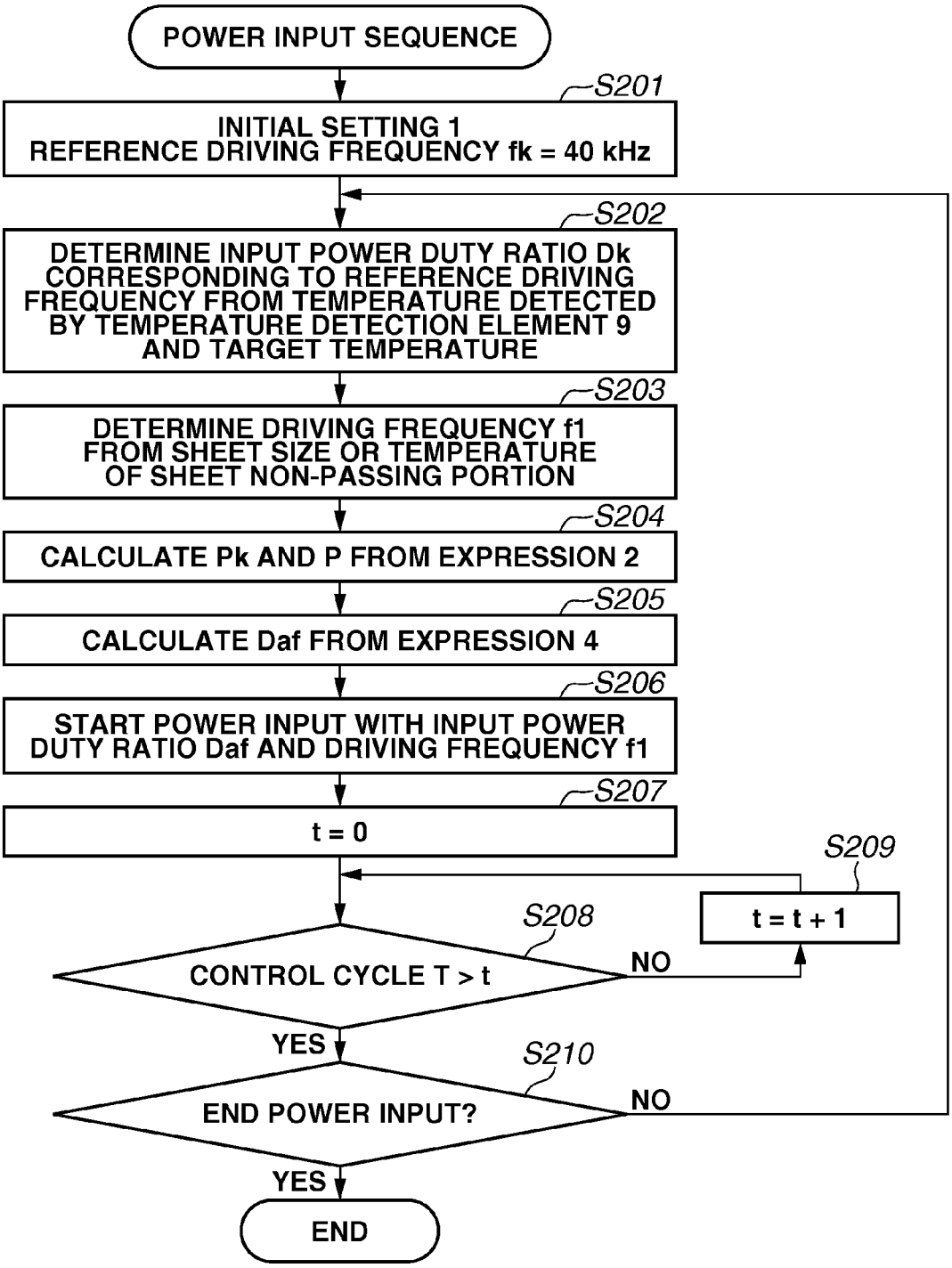
FIG. 16 is a flowchart illustrating a processing procedure according to an exemplary modification of the first exemplary embodiment.

FIG. 16 is a flowchart illustrating a power input sequence adopting the correction of the input power duty ratio according to the present exemplary modification. Descriptions of the points similar to the one described with reference to FIGS. 14A to 14C will be omitted here. After a start of the power input sequence, in step S201, the reference driving frequency fk (40 kHz indicated in FIG. 14A in the present exemplary modification) is set, which is an only initial setting in this sequence. In step S202, the input power duty ratio Dk of the power input from the second converter 15 is determined, the input power duty ratio Dk of the power input from the second converter 15 being of when the first converter 16 is driven with the reference frequency fk, from the temperature detected by the temperature detection element 9 and the target temperature. Subsequently, the driving frequency f1, and Pk and P are calculated in a similar manner described in the flowchart illustrated in FIG. 15. In step S205, the input power duty ratio Daf is determined with use of the expression (4). The sequence after that is similar to the one described with reference to FIGS. 14A to 14C.

The present exemplary modification sets the target power to the predetermined power corresponding to the reference driving frequency fk regardless of the driving frequency f1, thereby allowing the input power supplied to the fixing unit A to be unchanged or less changed and the temperature ripple of the fixing unit A to be prevented from occurring even when the driving frequency is changed.

According to the first exemplary embodiment and the exemplary modification thereof, the input power duty ratio of the second converter 15 is switched at the same time when the driving frequency of the first converter 16 is switched. However, the duty ratio may be switched at a timing before or after a predetermined time of when the driving frequency is changed. The predetermined time here can be several milliseconds or dozens of milliseconds.

According to the above-described first exemplary embodiment and exemplary modification thereof, the film-shaped member is used as the rotational member (the fixing sleeve) 1. However, the present invention can be also applied to a fixing apparatus using a rigid rotational member having little flexibility as the rotational member with the core and the coil disposed therein.

A second exemplary embodiment is configured to set the driving frequency of the first converter 16 according to the size of the recording material P while the first exemplary embodiment is configured to set the driving frequency of the first converter 16 according to the temperature at the sheet non-passing portion.

As described above, the heat generation amount becomes lower at the longitudinal ends of the rotational member 1 than at the central portion of the rotational member 1, as the driving frequency of the first converter 16 reduces. The present exemplary embodiment utilizes this characteristic, and sets the driving frequency of the first converter 16 to a lower frequency as a width (a width in a direction perpendicular to a conveyance direction) of the recording material P reduces. The following table indicates the driving frequency for each size of the recording material P.

| | Letter Size | A4 Size | B5 Size | A5 Size |
|---|---|---|---|---|
| Size Of Recording Material P | Width 216 mm Length 279.4 mm | Width 210 mm Length 297 mm | Width 182 mm Length 257 mm | Width 148 mm Length 210 mm |
| Driving Frequency | 50 kHz | 44 kHz | 36 kHz | 20 kHz |

According to the present exemplary embodiment, the frequency setting unit 120 sets the driving frequency according to the information about the size of the recording material P that is specified by a user via the host computer 42.

Figure 12:
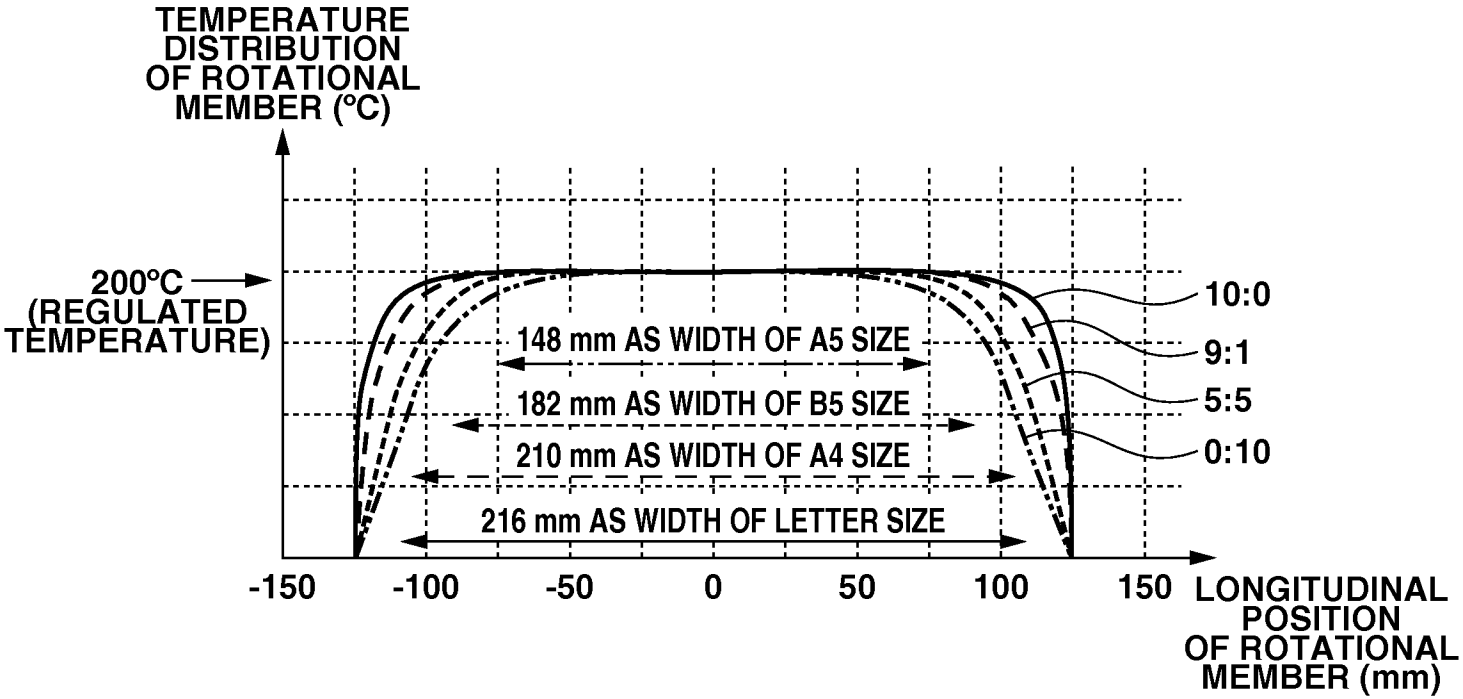
FIG. 12 is a diagram illustrating a relationship between a driving frequency and a temperature distribution of a fixing sleeve according to a second exemplary embodiment.

The driving frequency used when the recording material P corresponding to one size is processed by the fixing processing may be alternately switched between a first driving frequency and a second driving frequency lower than a first driving frequency. FIG. 12 illustrates temperature distributions of the rotational member 1 in a rotational axis direction in a case where a change is made in a ratio per unit time between a driving time period during which the first converter 16 is driven with the driving frequency of 20 kHz, and a driving time period during which the first converter 16 is driven with the driving frequency of 50 kHz. For example, assume that the ratio between the driving time periods as 20 kHz:50 kHz is 10:0 when the recording material P has the A5 size. Assume that the ratio between the driving time periods as 20 kHz:50 kHz is 5:5 when the recording material P has the B5 size. Assume that the ratio between the driving time periods as 20 kHz:50 kHz is 1:9 when the recording material P has the A4 size. Assume that the ratio between the driving time periods as 20 kHz:50 kHz is 0:10 when the recording material P has the letter size.

According to the above-described first and second exemplary embodiments, the film-shaped member is used as the rotational member (the fixing sleeve) 1. However, the present invention can be also applied to the fixing apparatus using a rigid rotational member having little flexibility as the rotational member with the core and the coil disposed therein.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-148884, filed Jul. 22, 2014, and No. 2014-189087, filed Sep. 17, 2014, which are hereby incorporated by reference herein in their entirety.

What is claimed is:

1. A fixing apparatus configured to fix an image onto a recording material, the fixing apparatus comprising:

a rotational member having a cylindrical shape and configured to include a conductive layer;

a coil having a helical shape and configured to be disposed inside the rotational member, the coil having a helix axis extending in a direction along a generatrix direction of the rotational member;

a resonance circuit including a resonance capacitor and configured to be formed together with the rotational member and the coil;

a first converter configured to drive the resonance circuit;

a second converter configured to be used to control power to be supplied to the first converter;

a frequency setting unit configured to set a driving frequency of the first converter according to at least one of a size of the recording material and a temperature at a sheet non-passing portion of the rotational member; and a power control unit configured to control the second converter according to a temperature at a sheet passing portion of the rotational member to control the power to be supplied to the first converter from the second converter, wherein the conductive layer is caused to generate heat by electromagnetic induction, and the image formed on the recording material is fixed onto the recording material with the heat of the rotational member.

2. The fixing apparatus according to claim 1, wherein the power control unit controls the second converter so as to maintain the temperature at the sheet passing portion of the rotational member at a target temperature.

3. The fixing apparatus according to claim 1, wherein the resonance circuit is a current resonance circuit.

4. The fixing apparatus according to claim 1, wherein the second converter is a voltage step-down converter.

5. The fixing apparatus according to claim 1, further comprising a core disposed inside a helical shaped portion of the coil and configured to guide the magnetic flux, wherein an induced current flowing in a circumferential direction of the rotational member is generated in the conductive layer.

6. The fixing apparatus according to claim 5, wherein the core has a shape having an end.

7. A fixing apparatus configured to fix an image onto a recording material, the fixing apparatus comprising:

a rotational member having a cylindrical shape and configured to include a conductive layer;

a coil having a helical shape and configured to be disposed inside the rotational member, the coil having a helix axis extending in a direction along a generatrix direction of the rotational member;

a resonance circuit including a resonance capacitor and configured to be formed together with the rotational member and the coil;

a first converter configured to drive the resonance circuit;

a second converter configured to be used to control power to be supplied to the first converter;

a frequency setting unit configured to set a driving frequency of the first converter according to at least one of a size of the recording material and a temperature at a sheet non-passing portion of the rotational member; and a power control unit configured to control the second converter according to a temperature at a sheet passing portion of the rotational member and the driving frequency to control the power to be supplied to the first converter from the second converter, wherein the conductive layer is caused to generate heat by electromagnetic induction, and the image formed on the recording material is fixed onto the recording material with the heat of the rotational member.

8. The fixing apparatus according to claim 7, wherein the power control unit controls the second converter so as to maintain the temperature at the sheet passing portion of the rotational member at a target temperature.

9. The fixing apparatus according to claim 7, wherein the resonance circuit is a current resonance circuit.

10. The fixing apparatus according to claim 7, wherein the second converter is a voltage step-down converter.

11. The fixing apparatus according to claim 7, further comprising a core disposed inside a helical shaped portion of the coil and configured to guide the magnetic flux, wherein an induced current flowing in a circumferential direction of the rotational member is generated in the conductive layer.

12. The fixing apparatus according to claim 11, wherein the core has a shape having an end.

* * * * *